US011927012B2

(12) United States Patent
Brewer

(10) Patent No.: US 11,927,012 B2
(45) Date of Patent: Mar. 12, 2024

(54) ONE PIECE MOLDED POST-TENSION TENDON POCKET FORMER WITH PUSH IN RETENTION TABS AND METHOD OF USE THEREOF

(71) Applicant: C&M Machines LLC, Rock Hill, SC (US)

(72) Inventor: Charles D. Brewer, York, SC (US)

(73) Assignee: C & M Machines LLC, Rock Hill, NC (US)

( * ) Notice: Subject to any disclaimer, the term of this patent is extended or adjusted under 35 U.S.C. 154(b) by 245 days.

(21) Appl. No.: 17/555,888

(22) Filed: Dec. 20, 2021

(65) Prior Publication Data

US 2022/0205245 A1 Jun. 30, 2022

Related U.S. Application Data

(60) Provisional application No. 63/130,475, filed on Dec. 24, 2020.

(51) Int. Cl.
*E04C 5/12* (2006.01)
*E04G 17/00* (2006.01)

(52) U.S. Cl.
CPC ..... *E04C 5/12* (2013.01); *E04G 17/00* (2013.01)

(58) Field of Classification Search
CPC ... E04C 5/12; E04C 5/08; E04G 17/00; E04G 21/185; E04B 1/4157; E04B 1/40; E04B 1/4114; E04B 1/4135; B28B 23/005; B28B 23/0056; B28B 23/12
See application file for complete search history.

(56) References Cited

U.S. PATENT DOCUMENTS

| | | | | |
|---|---|---|---|---|
| 2,002,526 | A | 5/1935 | Colt | |
| 2,164,592 | A | 7/1939 | Pilj | |
| 3,367,620 | A | 2/1968 | Holt | |
| 3,503,584 | A | 3/1970 | Erhart et al. | |
| 3,685,783 | A | 8/1972 | Hilson | |
| 3,798,866 | A | 3/1974 | Werstein | |
| 4,412,407 | A | 11/1983 | Melfi et al. | |
| 4,773,198 | A * | 9/1988 | Reinhardt | E04C 5/122 52/223.13 |
| 5,271,199 | A * | 12/1993 | Northern | E04C 5/12 52/223.13 |
| 5,415,510 | A | 5/1995 | Funaki et al. | |

(Continued)

*Primary Examiner* — Gisele D Ford
(74) *Attorney, Agent, or Firm* — Jeffrey C. Watson, Esq.; Grell & Watson Patent Attorneys LLC

(57) ABSTRACT

A one-piece post-tension tendon pocket former includes a pocket section configured to create a pocket in an edge of concrete, a formwork securing mechanism connected to the second end of the pocket section configured to secure the second end of the pocket section to a formwork, and an anchor securing mechanism. The anchor securing mechanism is configured to secure the pocket section to a post-tension tendon anchor with at least one fastener hole and includes an anchor sealing portion and at least one retention tab. The anchor sealing portion is configured to seal the pocket section to the post-tension tendon anchor. Each of the at least one retention tab extends from a side of the pocket section and is configured to be secured in one of the at least one fastener holes for securing the seal between the anchor sealing portion and the post-tension tendon anchor.

18 Claims, 10 Drawing Sheets

(56) References Cited

U.S. PATENT DOCUMENTS

| | | | | |
|---|---|---|---|---|
| 5,761,874 | A | 6/1998 | Hayakawa | |
| 7,025,522 | B2 | 4/2006 | Grubert et al. | |
| 8,950,137 | B2 | 2/2015 | Ciuperca | |
| 9,003,662 | B2 | 4/2015 | Burd et al. | |
| 9,303,399 | B2 | 4/2016 | Espinosa | |
| 9,388,841 | B2 | 7/2016 | Allmon et al. | |
| 9,394,706 | B2 | 7/2016 | Lin | |
| D865,505 | S | 11/2019 | Brewer et al. | |
| 10,633,861 | B2 | 4/2020 | Brewer et al. | |
| 11,111,941 | B2 * | 9/2021 | Pregartner | F16B 13/0825 |
| 2017/0275881 | A1 * | 9/2017 | Sorkin | E04C 5/12 |
| 2018/0313086 | A1 * | 11/2018 | Mathews | E04C 5/122 |
| 2019/0003182 | A1 * | 1/2019 | dos Santos | E04C 5/12 |
| 2019/0145103 | A1 * | 5/2019 | Brewer | E04C 5/12 52/223.13 |
| 2020/0378123 | A1 * | 12/2020 | Sorkin | E04G 21/12 |

* cited by examiner

ONE PIECE MOLDED POST-TENSION TENDON POCKET FORMER WITH PUSH IN RETENTION TABS AND METHOD OF USE THEREOF

CROSS-REFERENCE TO RELATED APPLICATIONS

To the full extent permitted by law, the present United States Non-provisional patent application hereby claims priority to and the full benefit of, U.S. Provisional Application No. 63/130,475, filed on Dec. 24, 2020, entitled "One Piece Molded Pocket Former With Push in Retention Tabs", which is incorporated by reference herein in its entirety.

FIELD OF THE DISCLOSURE

The present disclosure relates to post-tension concrete structures and means and methods for the installation of the post-tension tendons or cables used therein. More specifically, the present disclosure is directed to usage of a tendon pocket former with push in retention tabs that secure and align the anchor in one step to the formwork, and a method of use thereof.

BACKGROUND

Post-tensioned concrete is a variant of pre-stressed concrete where the tendons or cables are tensioned after the surrounding concrete structure has been cast. Construction of post-tensioned slabs on grade is very similar to using reinforcing steel, except for the tensioning step. Cables are arranged as indicated by the engineer and typically chaired to run through the center of the slab. For residential construction, tendons at 48 inches on center are common. Commercial foundations will have much more steel. Tendons can be easily routed around obstructions.

A residential post-tensioned concrete slab will typically be 8 inches thick and use 3000 psi concrete. Once the concrete has gained strength to 2000 psi, typically within the 3 to 10 days recommended by PTI, the tendons are stressed.

Tendons today are seven high-strength steel wires wound together and placed inside a plastic duct. At each end of the tendons, a post tension anchor is positioned for securing the cable or tendon and to distribute tensile force into the concrete by applying tension to the tendons. One end of the cable tendons requires a pocket to be formed so that stressing equipment can access the anchor for force application and wedge seating operations. When the strands are stressed, the tendons will stretch—about 4 inches for a 50 foot strand—to apply 33,000 pounds of load. Stressing of post-tension tendons is a dangerous job that requires a lot of skill and is typically only done by qualified workers. After stressing, the tendon is cut off and a grease cap is installed in encapsulated systems, to create a watertight seal, and then the pockets are filled with non-shrink grout to protect them from corrosion.

Larger structural concrete members may also be post-tensioned, especially in bridges and floors and beams in parking structures. The process is very similar to that used for slabs, except on a bigger scale. One interesting difference is that the tendons will often be "draped" so that they are low at the midpoint of a beam and high at the support, which places the steel at the point of highest tension where it can keep the concrete held together tightly. In multi-strand applications, with structural members the duct is often grouted full following stressing to bond the strand to the concrete along its entire length. When the duct is fully grouted, the combined duct, grout and tendons are called bonded tendons. On the other hand, in mono-strand applications, the duct is normally not grouted. Unbonded tendons, like those used in residential slabs and commercial low-rise buildings, remain free to move within the duct and are protected from corrosion by grease.

Post-tension tendon placement and stressing is usually done by companies with certified workers who specialize in this work. Current pocket formers for post tension cables only provide a small alignment ring for the anchor to plywood connection. This requires the user to hold the anchor in alignment and secure it using nails or screws. Holding the anchor, nail and a hammer is difficult in open situations but even harder in tight spaces, such as beams and columns with rebar. Others have used a threaded mandrel and nut that secures the anchor to the plywood formwork, but this still requires two people in areas where the opposing side of the formwork is not easily accessible. The mandrel approach also requires multiple pieces which makes it cumbersome.

As such, typically the pocket former and anchor assembly require nails or screws to hold the assembly in place during tendon installation and concrete placement. The installation of nails into the plywood is difficult because of rigidity and having to hold everything at one time. In addition, the use of nails only typically results in some back-outs of the assembly (ring shank nails may be used to limit this possibility), which takes constant supervision and time to deal with. Screws make this easier, but can make removal of the forms much more difficult, as the form has to be ripped off the head of the screws due to the head of the screws being buried in the concrete (i.e. the screws can not be unscrewed). As a result, both screws and nails are difficult to install and require extensions and creative methods when rebar is installed before the tendons are installed. Therefore, there is clearly a need to provide a means and method for faster and easier installation of the pocket former and anchor assembly with post-tension cables.

One solution to the problems noted above for post tension tendons was disclosed in U.S. Pat. No. 10,633,861, which is incorporated herein in its entirety. This patent disclosed a tendon pocket former with a ribbed formwork securing mechanism, and a method of use thereof. This tendon pocket former used an anchor securing mechanism that was configured to secure the first end of the pocket section of the pocket former to an anchor connected to the post tension tendon. This anchor securing mechanism disclosed therein included a small tapered section with a first set of anchor ribs and a slight tapered section with a second set of anchor ribs. The instant disclosure may recognize the need to improve this anchor securing mechanism by providing a different means for securing the pocket former to the anchor connected to the post tension tendon.

Currently the installation of a pocket former and post tension anchor assembly required the use of nails, or a special anchor and assembly system. This increases cost and installation time and requires manual removal of the fasteners or components. The use of metallic fasteners has the propensity to result in rust bleeding on the exterior of the building. Additionally, the metallic fasteners create a potential safety hazard as they are left protruding from the concrete surface after removal of the edge form.

Other systems that do not utilize nails or screws have multiple pieces or require special anchor modifications that prevent their wide spread use.

The instant disclosure is designed to address at least certain aspects of the problems or needs discussed above by providing a one piece molded post-tension tendon pocket former with push in retention tabs and a method of use thereof. The pocket former disclosed herein may be designed to work with all anchors widely available in the post tension market through the use of nail holes present in all such anchors.

SUMMARY

The present disclosure may solve the aforementioned limitations of the currently available pocket formers by providing a one-piece molded post-tension pocket former with push in retention tabs and a method of use thereof. The one-piece post-tension tendon pocket former may generally include a pocket section, an anchor securing mechanism, and a formwork securing mechanism. The pocket section may be configured to create a pocket in an edge of concrete. The formwork securing mechanism may be connected to the second end of the pocket section. The formwork securing mechanism may be configured to secure the second end of the pocket section to a formwork. The anchor securing mechanism may be configured to secure the pocket section to a post-tension tendon anchor with at least one fastener hole. The anchor securing mechanism may include an anchor sealing portion and at least one retention tab. The anchor sealing portion may be configured to seal the pocket section to the post-tension tendon anchor. Each of the at least one retention tab may extend from a side of the pocket section. Each of the at least one retention tabs may be configured to be secured in one of the at least one fastener holes for securing the seal between the anchor sealing portion and the post-tension tendon anchor.

One feature of the disclosed one-piece post-tension tendon pocket former with push in retention tabs may be that the pocket section, the formwork securing mechanism, and the anchor securing mechanism of the one-piece post-tension tendon pocket former may be integrally formed to create the one-piece post-tension pocket former.

Another feature of the disclosed one-piece post-tension tendon pocket former with push in retention tabs may be that the one-piece post-tension tendon pocket former with push in retention tabs may be configured so secure and align the anchor to the formwork.

In select embodiments of the disclosed one-piece post-tension tendon pocket former with push in retention tabs, where the post-tension tendon anchor used therewith has two fastener holes, the anchor securing mechanism may include two corresponding retention tabs. Th two retention tabs may extend from opposite sides of the pocket section. The two retention tabs may include a first retention tab and a second retention tab. The first retention tab may be configured to be secured in a first fastener hole of the post-tension tendon anchor. The second retention tab may be configured to be secured in a second fastener hole of the post-tension tendon anchor.

In select embodiments of the one-piece post-tension tendon pocket former with push in retention tabs, each of the retention tabs may include a transverse member and a parallel member. The transverse member may extend away from the side of the pocket section. The parallel member may be connected to a distal end of the transverse member. The parallel member may extend from the transverse member beyond the anchor sealing portion. In select embodiments, the transverse member of each of the retention tabs may include a rectangular cross-section. In other select embodiments, the parallel member of each of the retention tabs may include a circular cross-section. The parallel member of each of the retention tabs may include a securing portion at a securing end of each parallel member. The securing portion may be configured to secure the parallel member inside of one of the fastener holes of the post-tension tendon anchor. In select embodiments, the securing portion at the securing end of each parallel member may include a plurality of securing ribs. In select embodiments, the plurality of securing ribs on the securing portion at the securing end of each parallel member may be angled towards the transverse member. Whereby the securing ribs may be configured to prevent removal or backing out of the securing portion of the parallel member from the fastener hole of the post-tension tendon anchor. Whereby, the securing ribs may be configured to slightly deflect during insertion of the securing portion into the fastener hole of the post-tension tendon anchor.

One feature of the disclosed one-piece post-tension tendon pocket former with push in retention tabs may be that each of the at least one retention tabs may be configured to break away from the side of the pocket section when the anchor sealing portion is removed from the post-tension tendon anchor. In select embodiments, each of the at least one retention tabs may be configured to break away from the side of the pocket section when the pocket section with the anchor sealing portion is removed from the post-tension tendon anchor via a transverse member of each retention tabs breaking away from the side of the pocket section. Accordingly, the formwork securing mechanism has more strength than a breaking strength of the transverse member.

In select embodiments of the instant one-piece post-tension tendon pocket former with push in retention tabs, the anchor securing mechanism may include a small tapered section. The small tapered section may be connected to the first end of the pocket section. The small tapered section may be configured to be inserted into and secured in a tapered receiver of the anchor.

In other select embodiments of the instant one-piece post-tension tendon pocket former with push in retention tabs, the anchor securing mechanism may include a slight tapered section. The slight tapered section may be connected to the first end of the pocket section. The slight tapered section may be configured to seal to an internal anchor assembly seal area of the anchor.

In another embodiment of the instant one-piece post-tension tendon pocket former with push in retention tabs, the anchor securing mechanism may include a slight tapered section and a small tapered section. The slight tapered section may be connected to the first end of the pocket section. The slight tapered section may be configured to seal to an internal anchor assembly seal area of the anchor. The small tapered section may be connected to the slight tapered section. The small tapered section may be configured to be inserted into and secured in a tapered receiver of the anchor.

In select embodiments of the one-piece post-tension tendon pocket former with push in retention tabs, the formwork securing mechanism may include an alignment shaft with formwork ribs. The alignment shaft with the formwork ribs may be configured to be inserted into a hole in the formwork. In select embodiments, the formwork ribs on the alignment shaft of the formwork securing mechanism may be angled towards the second end of the pocket section. Whereby the formwork ribs may be configured to prevent removal or backing out of the alignment shaft once inserted into the hole in the formwork. In other select embodiments, the formwork ribs on the alignment shaft of the formwork securing mechanism may be tapered. Whereby, the tapered formwork ribs may slightly deflect during insertion of the alignment shaft into the hole in the formwork. The alignment shaft may have an extended length that extends from the second end of the pocket section to a distal alignment end of the alignment shaft. In select embodiments, the extended length of the alignment shaft may be sized to extend at least a thickness of the formwork. Whereby when the alignment shaft of the formwork securing mechanism is inserted through the hole in the formwork where the second end of the pocket section is aligned with an inner surface of the formwork, the distal alignment end of the alignment shaft and at least one of the formwork ribs on the alignment shaft may extend beyond an outer surface of the formwork. The formwork securing mechanism may be configured to secure the second end of the pocket section to any type of formwork, including, but not limited to, a plywood formwork or a medium-density fiberboard formwork.

In other select embodiments of the instant one-piece post-tension tendon pocket former with push in retention tabs, the pocket section may have a large tapered section. The large tapered section may be between the first end and the second end of the pocket section. The large tapered section may be configured to create the pocket in the edge of the concrete. The pocket created with the large tapered section may be configured to allow tension to be applied to a tendon connected to the anchor. In select embodiments, the large tapered section could also be increased or decreased in diameter and could be made in multiple shapes to allow cut-off tool access. In select embodiments, the large tapered section of the pocket section may include a hollow interior supported by a plurality of spokes. The hollow interior of the large tapered section of the pocket section may include any number of spokes, including, but not limited to, five spokes for supporting the hollow interior.

In another aspect, the instant disclosure embraces a method of creating pockets in concrete for post-tension tendons. The instant method of creating pockets in concrete for post-tension tendons generally may include the step of providing the one-piece post-tension tendon pocket former with push in retention tabs in any of the various embodiments shown and/or described herein. As such, the provided one-piece post-tension tendon pocket former with push in retention tabs may generally include a pocket section, a formwork securing mechanism and an anchor securing mechanism. The pocket section may be configured to create a pocket in an edge of concrete. The pocket section may include a first end and a second end. The formwork securing mechanism may be connected to the second end of the pocket section. The formwork securing mechanism may be configured to secure the second end of the pocket section to a formwork. The anchor securing mechanism may be connected to the first end of the pocket section. The anchor securing mechanism may be configured to secure the first end of the pocket section to a post-tension tendon anchor with at least one fastener hole. The anchor securing mechanism may include an anchor sealing portion and at least one retention tab. The anchor sealing portion may be configured to seal the first end of the pocket section to the post-tension tendon anchor. The at least one retention tab may extend from a side of the pocket section. Each of the at least one retention tabs may be configured to be secured in one of the at least one fastener holes of the post-tension tendon anchor for securing the seal between the anchor sealing portion and the post-tension tendon anchor.

In select embodiments of the instant method of creating pockets in concrete for post-tension tendons, the step of forming a pocket in the edge of the concrete with the provided one-piece post-tension tendon pocket former with push in retention tabs may also include: drilling at least one hole in the formwork at a desired position; attaching the formwork securing mechanism to the hole drilled in the formwork; attaching the anchor to the anchor securing mechanism including pushing each of the retention tabs into one of the fastener holes in the post-tension tendon anchor; positioning the formwork in the desired location for the concrete; attaching a tendon to the anchor; pouring the concrete; waiting for the concrete to set; and removing the formwork from the edge of the concrete. Whereby, the one-piece post-tension pocket former with push in retention tabs remains attached to the formwork and pulls away from the anchor where each of the retention tabs breaks away from the sides of the pocket section thereby creating the pocket in the edge of the concrete configured to allow tension to be applied to the tendon connected to the anchor, the cable to be cut, grease cap/corrosion protection installed, grout applied, the like, etc.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
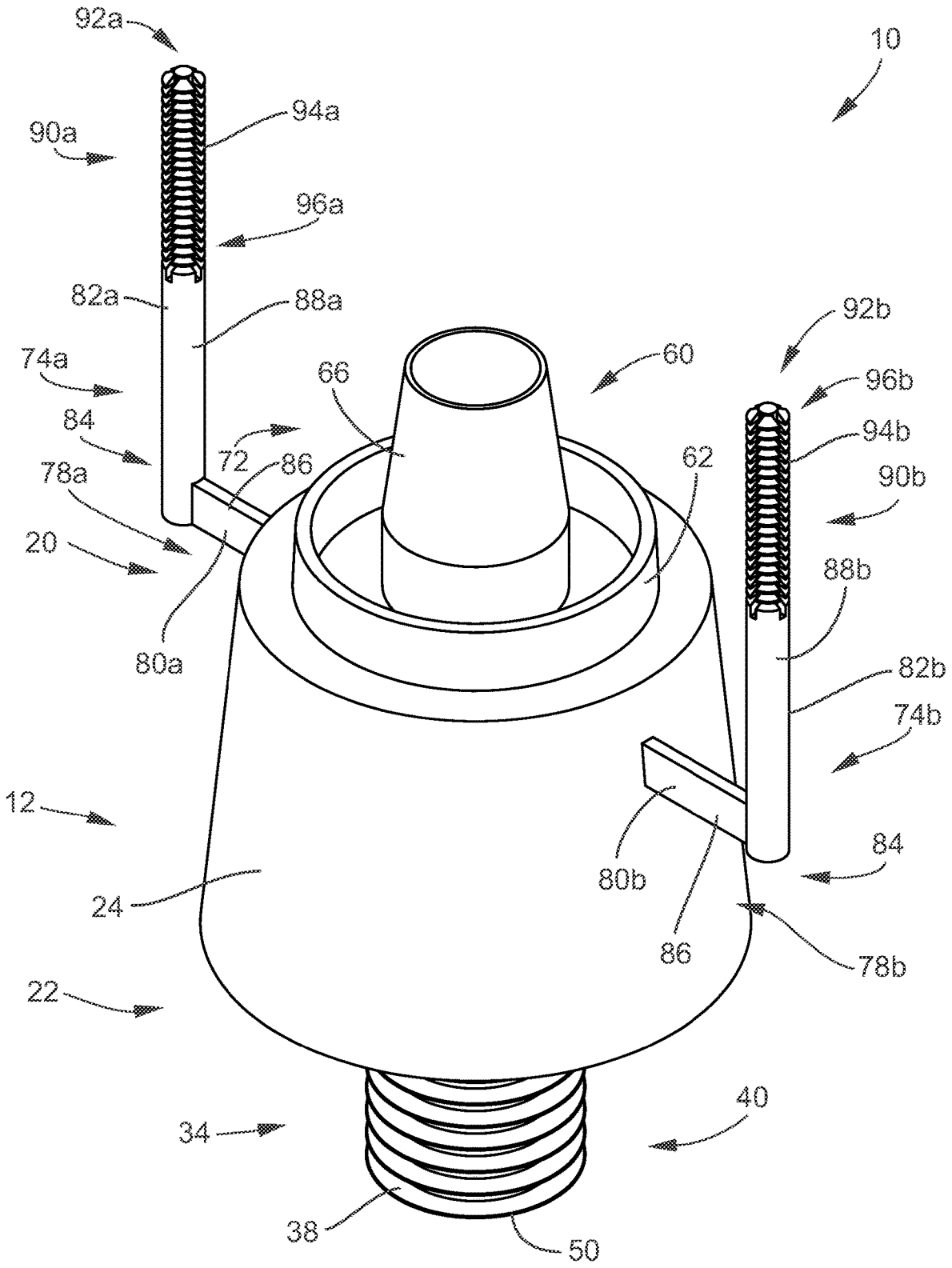
FIG. 1 is a perspective top view of the one piece molded post-tension tendon pocket former with push in retention tabs according to select embodiments of the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-9, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring now to FIGS. 1-8, in a possibly preferred embodiment, the present disclosure overcomes the above-mentioned disadvantages and meets the recognized need for such an apparatus or method by providing of one-piece post-tension tendon pocket former 10 with push in retention tabs 74. One-piece post-tension pocket former 10 may be for providing a one-piece pocket former that secures, and aligns anchor 28 in one step to the formwork 36, like plywood formwork 56. As such, one feature of one-piece post-tension tendon pocket former 10 may be that it can be configured so secure and align anchor 28 to formwork 36, as shown in FIGS. 8A, 8B and 8C. One-piece post-tension pocket former 10 may designed to make it easy for a single man installation in a fraction of the time. One-piece post-tension pocket former 10 may generally include pocket section 12, formwork securing mechanism 34 and anchor securing mechanism 60. Formwork securing mechanism 34 may be connected to second end 22 of pocket section 12. As such, formwork securing mechanism 34 may be configured to secure second end 22 of pocket section 12 to formwork 36. Anchor securing mechanism 60 may be connected to first end 20 of pocket section 12. Anchor securing mechanism 60 may be configured to secure first end 20 of pocket section 12 to anchor 28. These parts and their components and function will be described in greater detail below.

In select embodiments of one-piece post-tension tendon pocket former 10, pocket section 12, formwork securing mechanism 34 and anchor securing mechanism 60 may be integrally formed. As such, the integral formation of the components of post-tension tendon pocket former 10 may create one-piece pocket former 10, as shown in the Figures. Specifically, referring to FIG. 7, as shown in this cross-section view of one-piece pocket former 10, all components are created or formed together. As examples, and clearly not limited thereto, one-piece post-tension tendon pocket former 10 may be made out of high-density plastic, which can be injection molded, 3D printed, or cast. In an alternative embodiment, one could make a mandrel with the ribs and make the disclosure 2 pieces.

Figure 2:
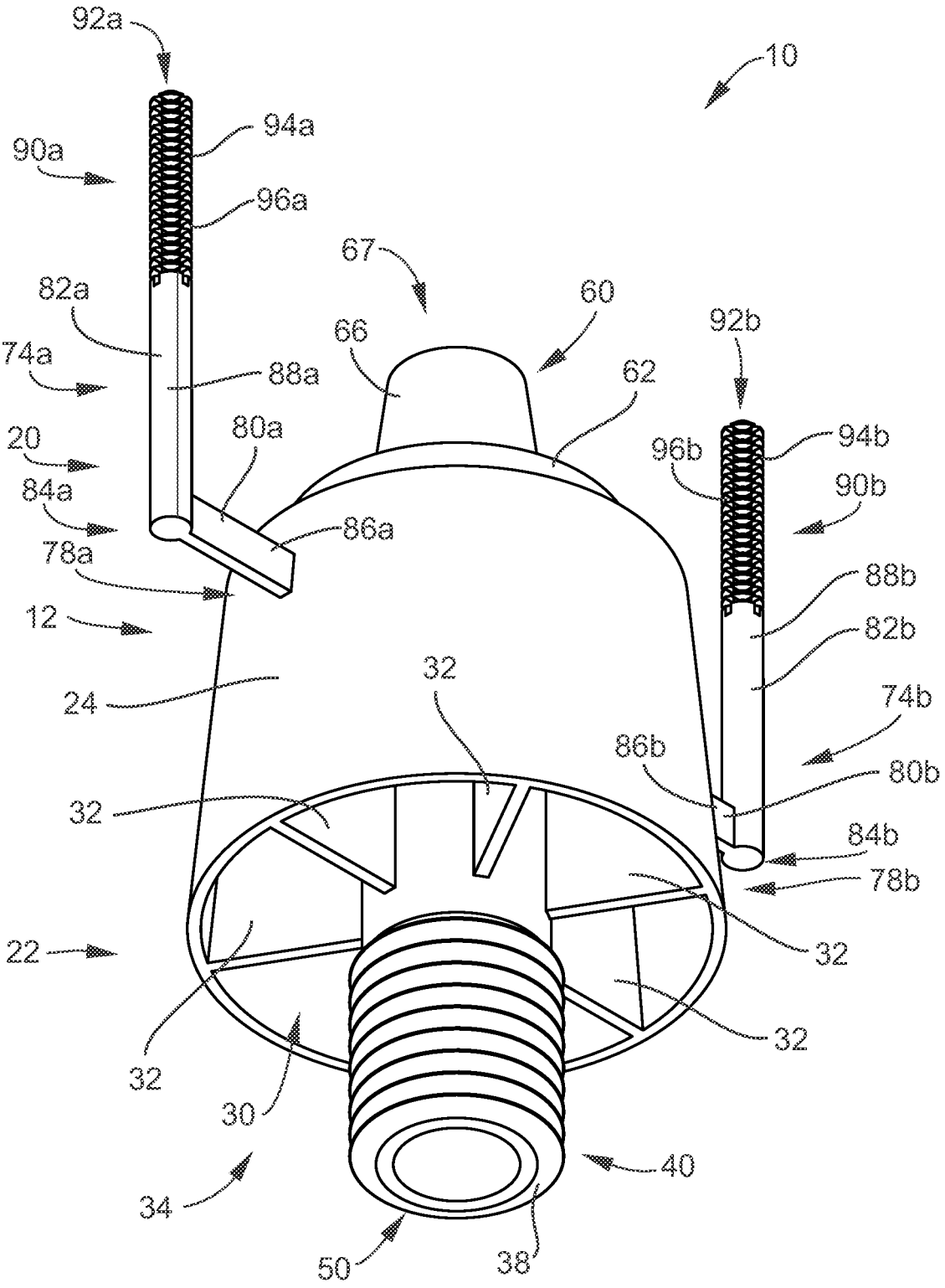
FIG. 2 is a perspective bottom view of the one piece molded post-tension tendon pocket former with push in retention tabs of FIG. 1.
Figure 6:
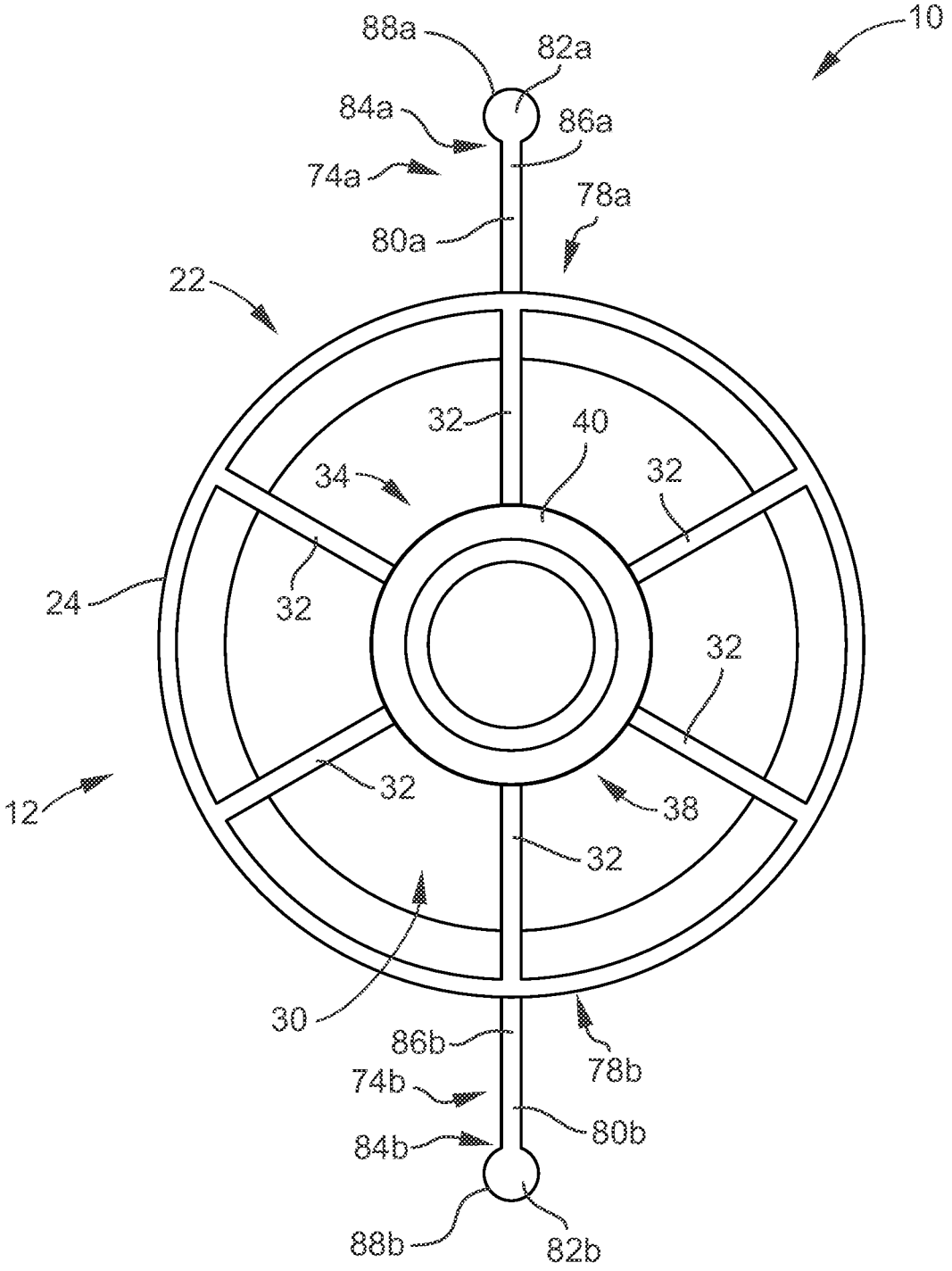
FIG. 6 is a bottom view of the one piece molded post-tension tendon pocket former with push in retention tabs of FIG. 1.
Figure 7:
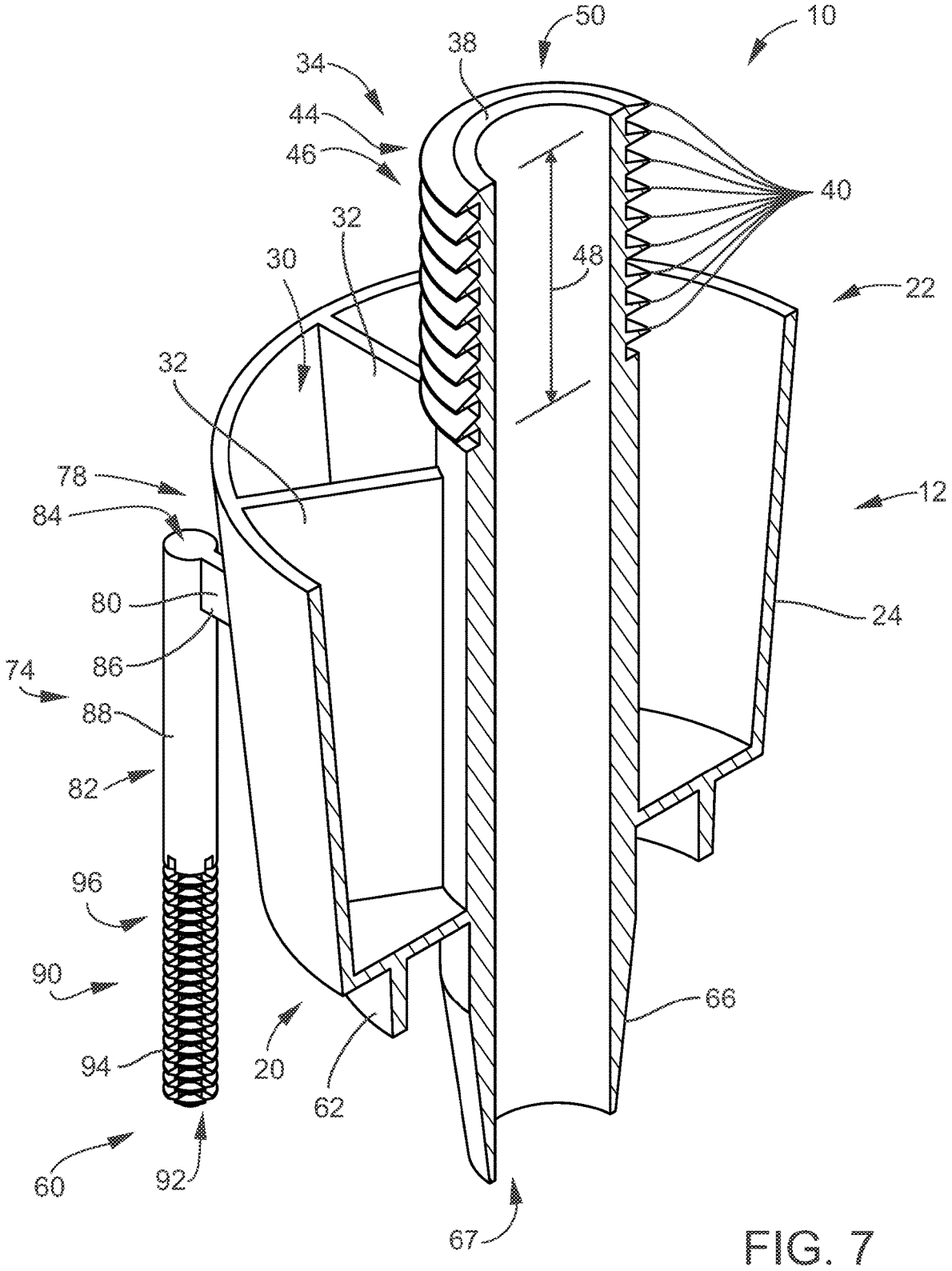
FIG. 7 is a cross-sectional perspective view of the one piece molded post-tension tendon pocket former with push in retention tabs of FIG. 1.

Pocket section 12 may be included with post-tension pocket former 10. Pocket section 12 may be for providing the space or material sized to create a pocket in an edge of concrete. As such, pocket section 12 may be configured to create a pocket in the edge of concrete. Pocket section 12 may include first end 20 and second end 22. First end 20 may be adjacent or connected to formwork securing mechanism 34. As such, first end 20 may provide the means or material for attaching formwork securing mechanism 34 to pocket section 12. Second end 22 may be adjacent or connected to anchor securing mechanism 60. As such, second end 22 may provide the means or material for attaching anchor securing mechanism 60 to pocket section 12. In select embodiments, pocket section 12 may have large tapered section 24. Large tapered section 24 may be between first end 20 and second end 22 of pocket section 12. Large tapered section 24 may be configured to create pocket 14 in edge 16 of concrete 18. Pocket 14 created with large tapered section 24 may be configured to allow tension to be applied to tendon 26 connected to anchor 28. In select embodiments, large tapered section 24 could also be increased or decreased in diameter and could be made in multiple shapes to allow cut-off tool access. Large tapered section 24 may be any desired size, shape and configuration for creating any desired size, shape and configuration of the pocket in the edge of the concrete. In select embodiments, large tapered section 24 of pocket section 12 may include hollow interior 30. Hollow interior 30 may be supported or reinforced under the weight of the poured concrete by a plurality of spokes 32. Hollow interior of large tapered section 24 of pocket section 12 may include any number of spokes 32, including, but not limited to, six spokes 32 for supporting hollow interior 30, as best shown in FIGS. 2 and 6.

Figures 8A, 8B:
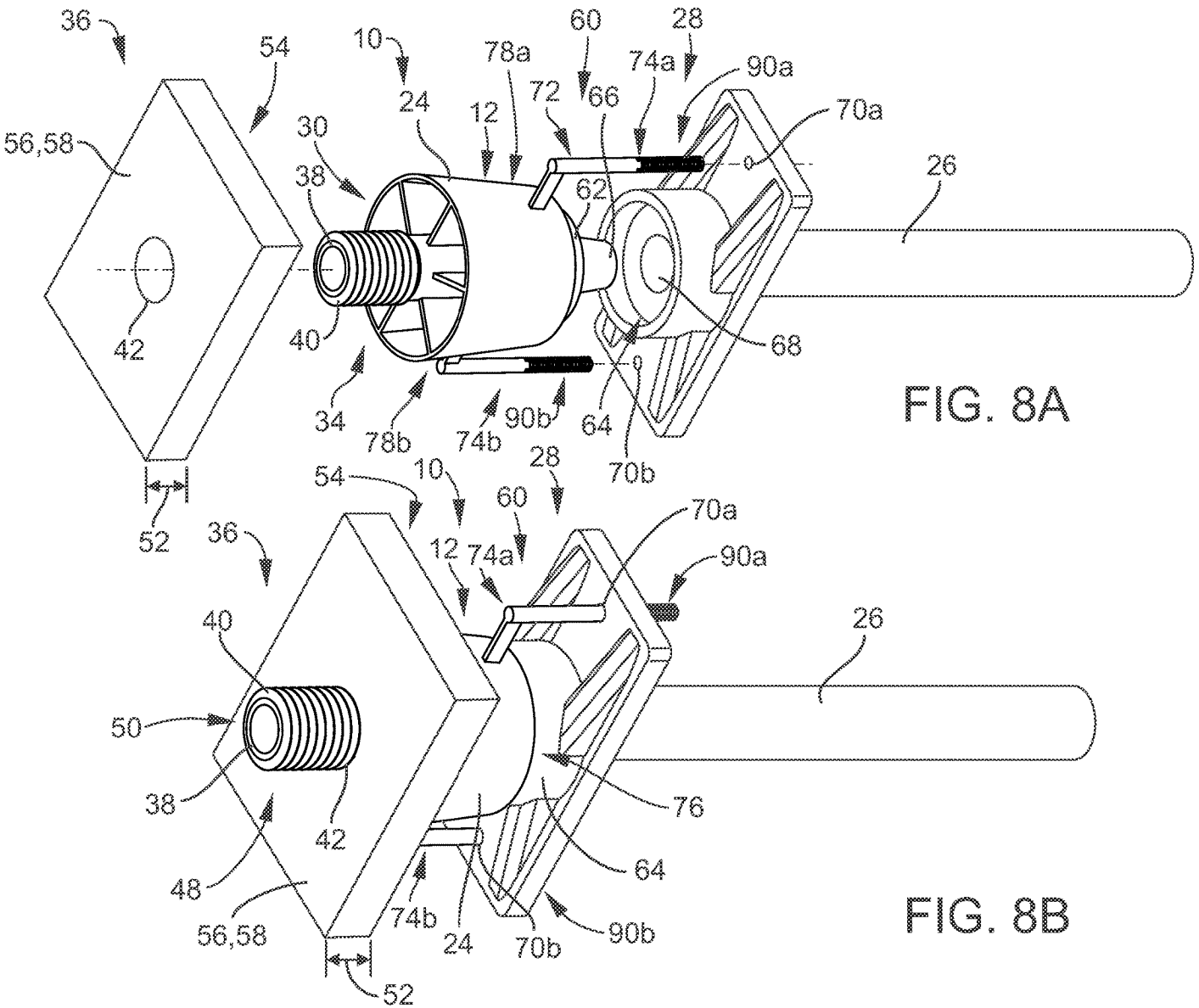
FIG. 8A is a perspective bottom end view of the one piece molded post-tension tendon pocket former with push in retention tabs according to select embodiments of the instant disclosure shown positioned and aligned between the post tension anchor assembly and the formwork with the required hole drilled.
FIG. 8B is a perspective bottom end view of the one piece molded post-tension tendon pocket former with push in retention tabs according to select embodiments of the instant disclosure shown positioned between the post tension anchor assembly and the formwork with the required hole drilled.

Formwork securing mechanism 34 may be included with post-tension pocket former 10. Formwork securing mechanism 34 may be for securing second end 22 of pocket section 12 to inner surface 54. See FIGS. 8A-8C. Formwork securing mechanism 34 may be designed and configured to tightly hold and secure post-tension pocket former 10 in hole 42 of formwork 36. Formwork securing mechanism 34 may include any devices, components, or means for securing second end 22 of pocket section 12 to inner surface 54. In select embodiments, formwork securing mechanism 34 may include alignment shaft 38 with formwork ribs 40. Alignment shaft 38 may be configured to align post-tension pocket former 10 in a desired orientation to inner surface 54 of formwork 36, including, but not limited to, perpendicular, as shown in the Figures. In select embodiments, alignment shaft 38 may extend completely through the middle of post-tension pocket former 10, as shown in the cross-section of FIG. 7. Formwork ribs 40 may be included on alignment shaft 38 to secure formwork securing mechanism inside hole 42 of formwork 36. Formwork ribs 40 may thus help to prevent back-outs of the post-tension pocket former, which typically occur with a nailed system. Additionally, when fasteners are used, post-tension pocket former 10 can still be installed with a single person, as the anchor 28 will at least be held in place on formwork 36 with formwork securing mechanism 34 while the fasteners are installed. Alignment shaft 38 with formwork ribs 40 may thus be configured to be inserted into hole 42 in formwork 36. In select embodiments, formwork ribs 40 on alignment shaft 38 of formwork securing mechanism 34 may be angled towards second end 22 of pocket section 12, as indicated with angles 44 best shown in FIGS. 3, 4 and 7. Whereby, with angles 44 angled towards second end 22 of pocket section 12, formwork ribs 40 may be configured to prevent removal or backing out of alignment shaft 38 once inserted into hole 42 in formwork 36. In select embodiments, formwork ribs 40 on alignment shaft 38 of formwork securing mechanism 34 may be tapered, as indicated with tapers 46 best shown in FIGS. 3, 4 and 7. Whereby, the formwork ribs 40 with tapers 46 may be designed and configured to slightly deflect during insertion of alignment shaft 38 into hole 42 in formwork 36. Alignment shaft 38 may have extended length 48 that extends from second end 22 of pocket section 12 to distal alignment end 50. See FIG. 7. In select embodiments, extended length 48 of alignment shaft 38 may be sized to extend at least thickness 52 of formwork 36 (thickness 52 best shown in FIGS. 8B and 8C). Whereby, when alignment shaft 38 of formwork securing mechanism 34 is inserted through hole 42 in formwork 36 where second end 22 of pocket section 12 is aligned with inner surface 54 of formwork 36, distal alignment end 50 of alignment shaft 38 and at least one of the formwork ribs 40 on alignment shaft 38 may extend beyond outer surface 55 of formwork 36, as best shown in FIGS. 8A and 8B. Extended length 48 of alignment shaft 38 may also enable alignment in different formwork thicknesses 52. Formwork securing mechanism 34 may be configured to secure second end 22 of pocket section 12 to any type of formwork 36, including, but not limited to, plywood formwork 56, medium-density fiberboard formwork 58, the like, and/or combinations thereof.

Figure 8C:
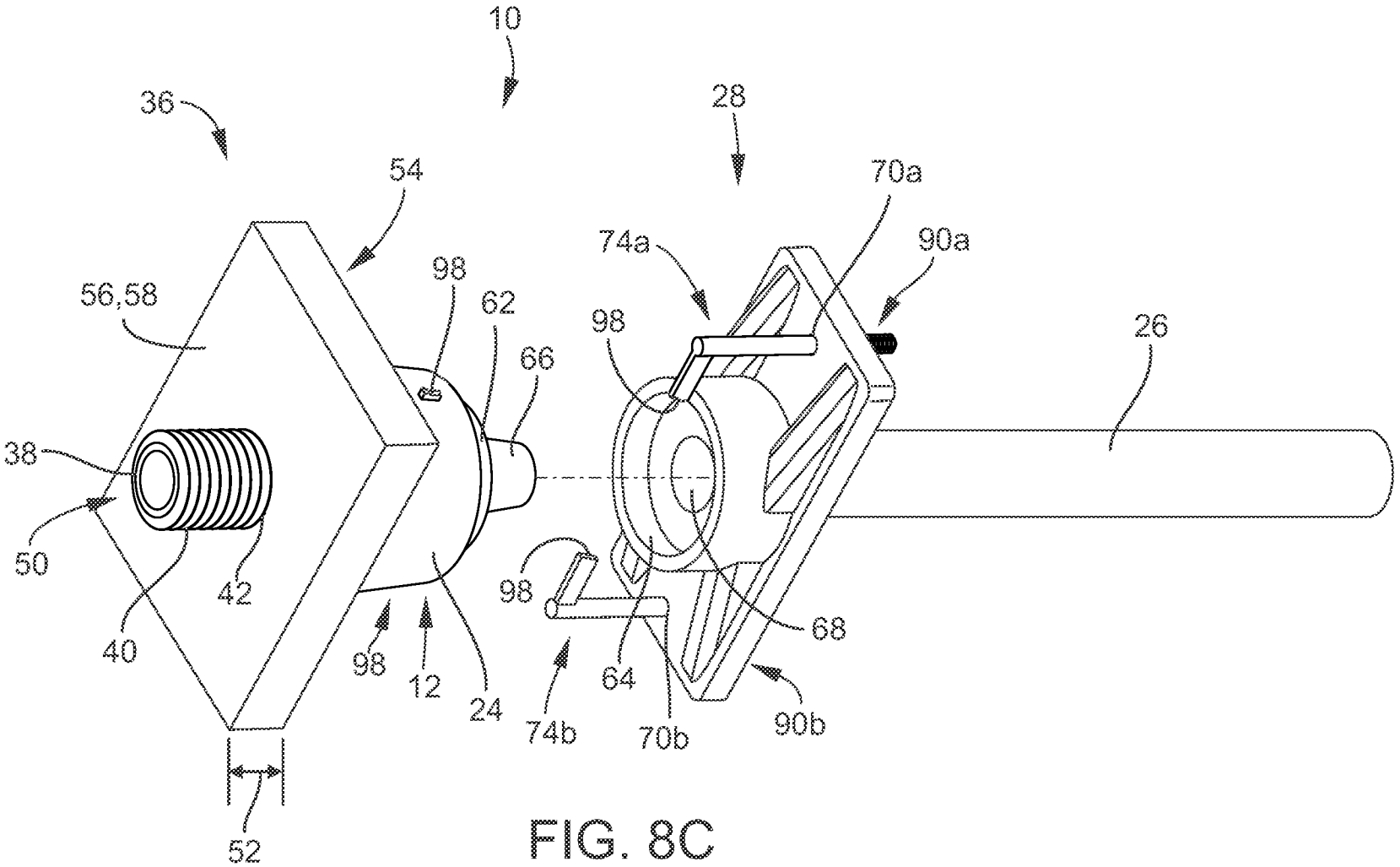
FIG. 8C is a perspective bottom end view of the one piece molded post-tension tendon pocket former with push in retention tabs according to select embodiments of the instant disclosure shown positioned between the post tension anchor assembly and the formwork with the required hole drilled.

Anchor securing mechanism 60 may be included with post-tension pocket former 10. Anchor securing mechanism 60 may be for securing first end 20 of pocket section 12 to anchor 28. Anchor securing mechanism 60 may include any devices, components, or means for securing first end 20 of pocket section 12 to anchor 28. Anchor securing mechanism 60 may be configured to secure pocket section 12 to post-tension tendon anchor 28 with at least one fastener hole 70, as shown in FIGS. 8A, 8B and 8C. Anchor securing mechanism 60 may include anchor sealing portion 72 and at least one retention tab 74. Anchor sealing portion 72 may be configured to seal pocket section 12 to post-tension tendon anchor 28. Each of the at least one retention tabs 74 may extend from side 78 of pocket section 12. Each of the at least one retention tabs 74 may be configured to be secured in one of the at least one fastener holes 70 for securing seal 76 between anchor sealing portion 72 and post-tension tendon anchor 28, as shown in FIG. 8B.

In select embodiments of one-piece post-tension tendon pocket former 10 with push in retention tabs 74, as shown in FIGS. 8A, 8B and 8C where post-tension tendon anchor 28 used therewith has two fastener holes 70 (designated as 70*a* and 70*b*), anchor securing mechanism 60 may include two corresponding retention tabs 74 (designated as 74*a* and 74*b*, respectively). The two retention tabs 74*a* and 74*b* may extend from opposite sides 78*a* and 78*b* of pocket section 12. The two retention tabs 74*a* and 74*b* may include first retention tab 74*a* and second retention tab 74*b*. First retention tab 74*a* may be configured to be secured in first fastener hole 70*a* of post-tension tendon anchor 28. Second retention tab 74*b* may be configured to be secured in second fastener hole 70*b* of post-tension tendon anchor 28. As such, first retention tab 74*a* and second retention tab 74*b* may be sized, designed and configured to align with first fastener hole 70*a* and second fastener hole 70*b*, respectively, while anchor sealing portion 72 is inserted and sealed within internal anchor assembly seal area 64 of post-tension anchor 28. First retention tab 74*a* and second retention tab 74*b* may be sized, designed and configured to align with any type or size of post-tension anchor 28 including any size, design or amount of fastener holes 70.

Figure 3:
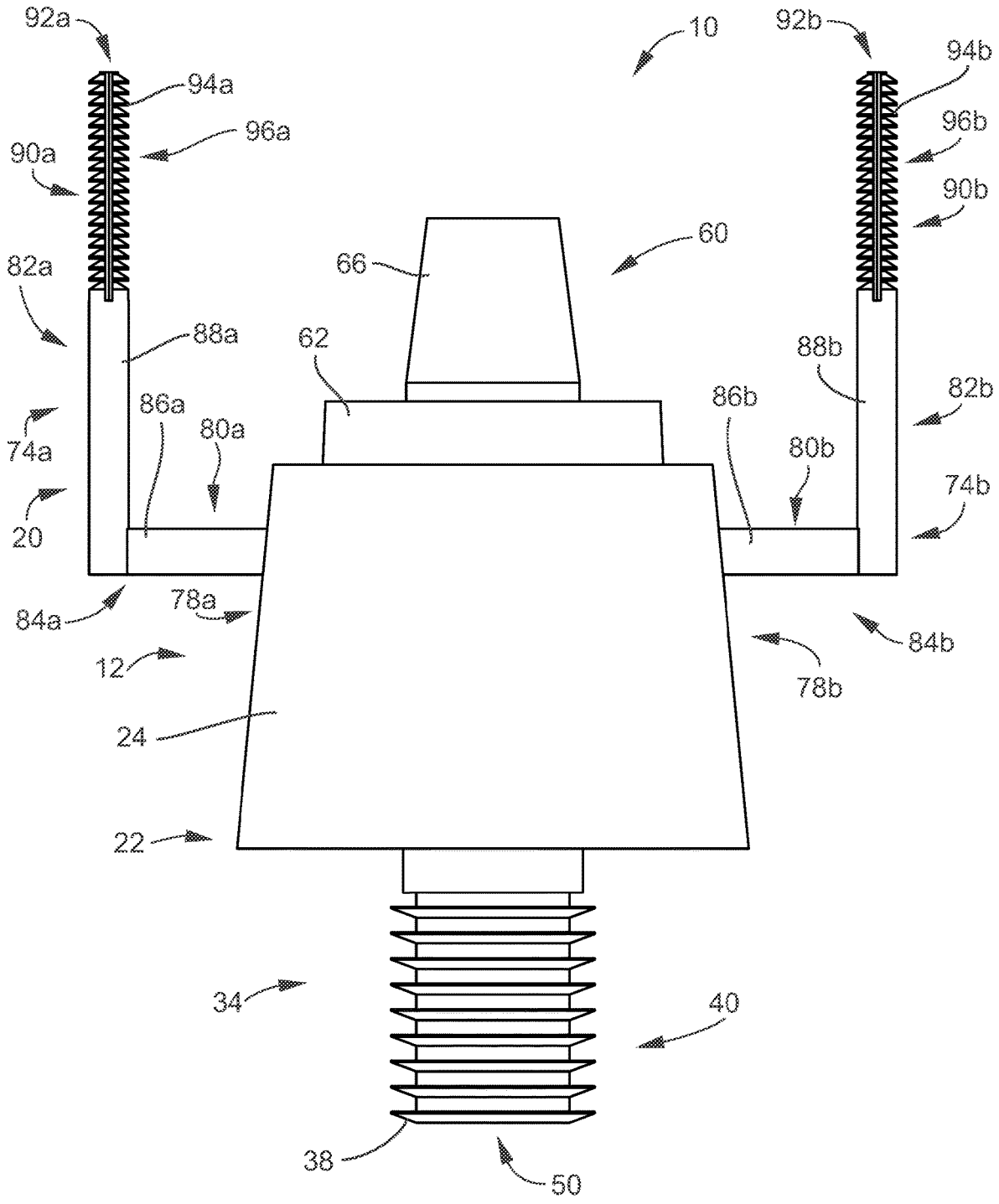
FIG. 3 is a front or rear side view of the one piece molded post-tension tendon pocket former with push in retention tabs of FIG. 1.
Figure 4:
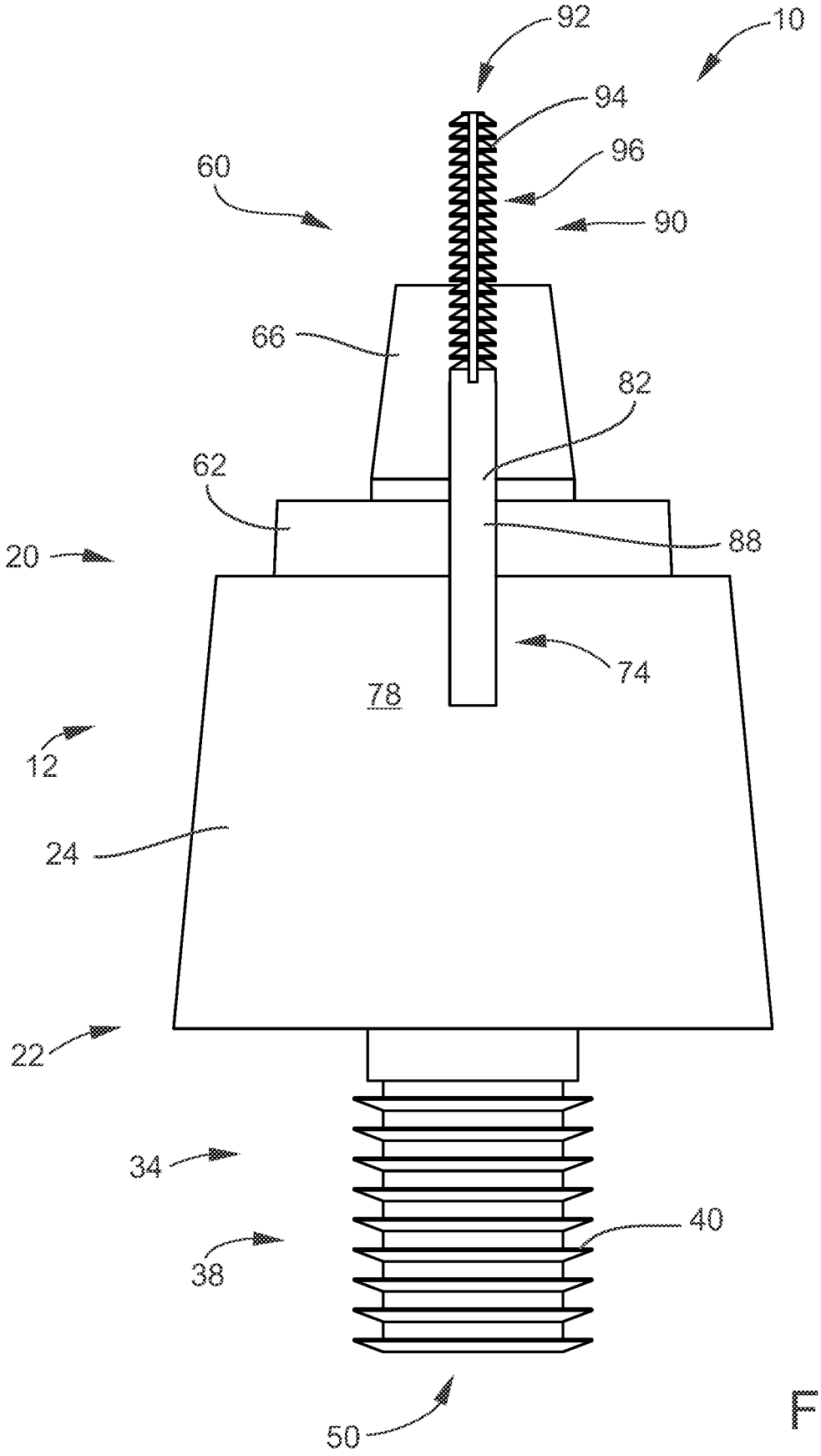
FIG. 4 is a left side or right side view of the one piece molded post-tension tendon pocket former with push in retention tabs of FIG. 1.
Figure 5:
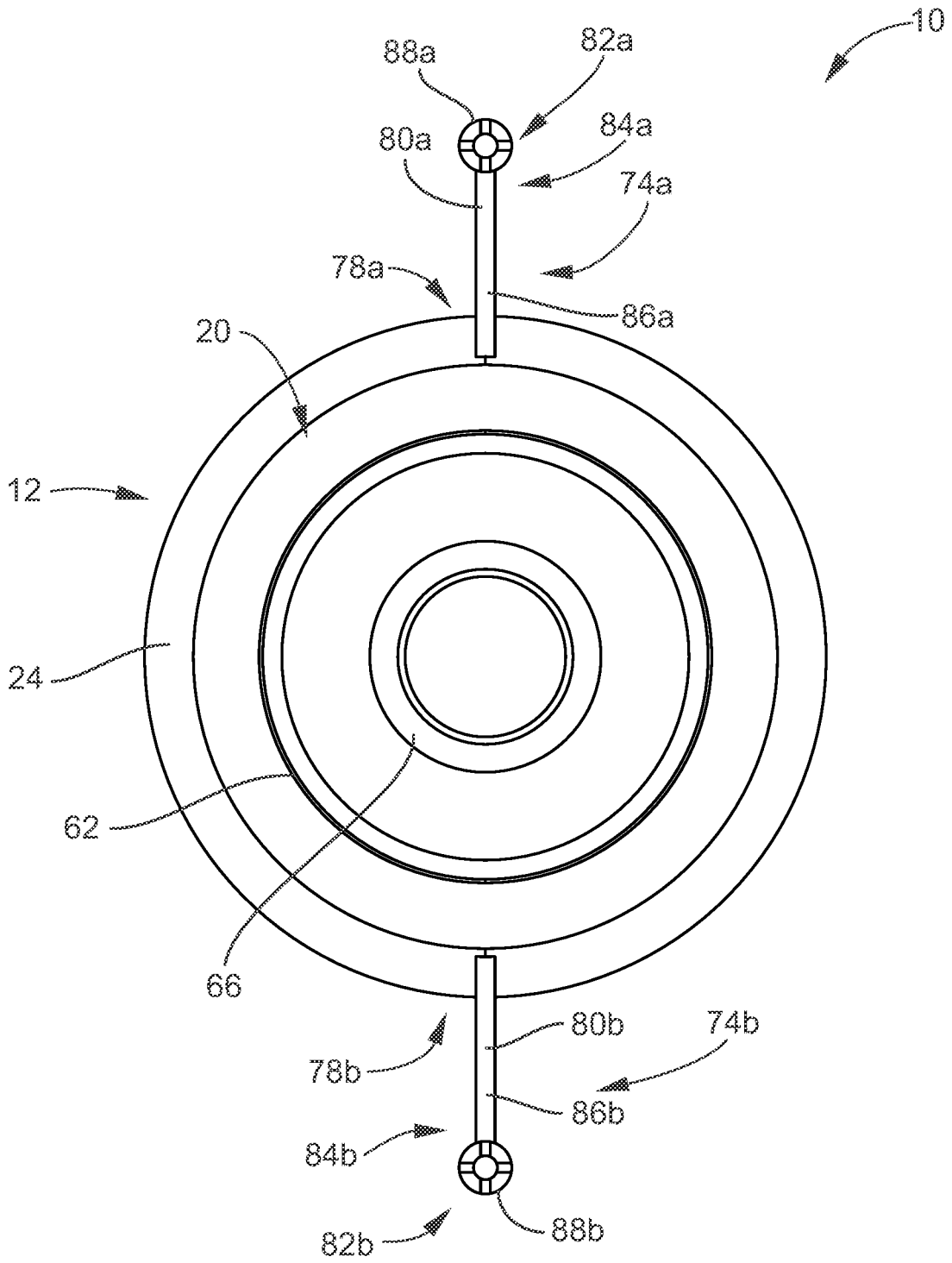
FIG. 5 is a top view of the one piece molded post-tension tendon pocket former with push in retention tabs of FIG. 1.

In select embodiments of one-piece post-tension tendon pocket former 10 former with push in retention tabs 74, each of the retention tabs 74 may include transverse member 80 (80*a* and 80*b*, as shown in the Figures for first push in retention tab 74*a* and second push in retention tab 74*b*, respectively) and parallel member 82 (82*a* and 82*b*, as shown in the Figures for first push in retention tab 74*a* and second push in retention tab 74*b*, respectively). Each transverse member 80 may extend away from side 78 (78*a* and 78*b*, as shown in the Figures for first push in retention tab 74*a* and second push in retention tab 74*b*, respectively) of pocket section 12. Parallel member 82 may be connected to distal end 84 (84*a* and 84*b*, as shown in the Figures for first push in retention tab 74*a* and second push in retention tab 74*b*, respectively) of transverse member 80. Each parallel member 82 may extend from transverse member 80 beyond anchor sealing portion 72, as best shown in FIGS. 8B and 8C. This length of each parallel member 82 may allow for each push in retention tab 74 to be inserted securely inside of each fastener hole 70 of post-tension anchor 28. In select embodiments, transverse member 80 of each retention tab 74 may include rectangular cross-section 86 (86*a* and 86*b*, as shown in the Figures for first push in retention tab 74*a* and second push in retention tab 74*b*, respectively). In other select embodiments, parallel member 82 of each retention tab 74 may include circular cross-section 88 (88*a* and 88*b*, as shown in the Figures for first push in retention tab 74*a* and second push in retention tab 74*b*, respectively). Each parallel member 82 of each of the retention tabs 74 may include securing portion 90 (90*a* and 90*b*, as shown in the Figures for first push in retention tab 74*a* and second push in retention tab 74*b*, respectively) at securing end 92 (92*a* and 92*b*, as shown in the Figures for first push in retention tab 74*a* and second push in retention tab 74*b*, respectively) of each parallel member 82. Securing portion 90 may be configured to secure parallel member 82 inside of one of fastener holes 70 of post-tension tendon anchor 28. In select embodiments, each securing portion 90 at the corresponding securing end 92 of each parallel member 82 may include plurality of securing ribs 94 (94*a* and 94*b*, as shown in the Figures for first push in retention tab 74*a* and second push in retention tab 74*b*, respectively). In select embodiments, plurality of securing ribs 94 on the corresponding securing portion 90 at securing end 92 of each parallel member 82 may be angled towards the corresponding transverse member 80. This angle of securing ribs 94 may be represented by angle 96 (96*a* and 96*b*, (as represented by angle 96) in the Figures, as best shown in FIGS. 3 and 4. Whereby, the securing ribs 94 may be configured to prevent removal or backing out of the securing portion 90 of the corresponding parallel member 82 from the corresponding fastener hole 70 of post-tension tendon anchor 28. In select embodiment, securing ribs 94 may be configured to slightly deflect during insertion of securing portion 90 into the corresponding fastener hole 70 of post-tension tendon anchor 28.

Referring now specifically to FIG. 8C, one feature of one-piece post-tension tendon pocket former 10 with push in retention tabs 74 may be that each of the at least one retention tabs 74 may be configured to break away from the corresponding side 78 of pocket section 12 when anchor sealing portion 72 is removed from post-tension tendon anchor 28. In select embodiments, each of the at least one retention tabs 74 may be configured to break away from the side 78 of pocket section 12 when pocket section 12 with anchor sealing portion 72 is removed from post-tension tendon anchor 28 via transverse member 80 of each retention tabs 74 breaking away from the corresponding side 78 of pocket section 12. This is generally shown as break away 98 in FIG. 8C. However, the disclosure is not so limited to the break-away point 98 shown in the Figures, and break away 98 could be configured at any portion of push in retention tabs 74. Accordingly, formwork securing mechanism 34 with formwork ribs 40 may be secured in hole 42 of formwork 36 with more strength than a breaking strength of transverse member 80.

In select embodiments, anchor securing mechanism 60 may include small tapered section 66. Small tapered section 66 may be for insertion into anchor 28 to prevent concrete intrusion. Small tapered section 66 may be configured and sized to fit tightly in the area where cable wedges would normally be installed in anchor 28. Small tapered section 66 may be connected to first end 20 of pocket section 12. Small tapered section 66 may be configured to be inserted into and secured in tapered receiver 68 of anchor 28.

In other select embodiments, anchor securing mechanism 60 may include slight tapered section 62. Slight tapered section 62 may ensure a tight seal 76 to anchor 28 configured for preventing concrete 18 from getting to the surface of anchor 28. Slight tapered section 62 may be connected to first end 20 of pocket section 12. Slight tapered section 62 may be configured to seal to internal anchor assembly seal area 64 of anchor 28

In yet another embodiment, anchor securing mechanism 60 may include slight tapered section 62 and small tapered section 66, as shown in the FIGS. Slight tapered section 62 may be connected to first end 20 of pocket section 12. Slight tapered section 62 may be configured to seal to internal anchor assembly seal area 64 of anchor 28, as discussed above. Small tapered section 66 may be connected to slight tapered section 62. Small tapered section 66 may be configured to be inserted into and secured in tapered receiver 68 of anchor 28, as discussed above.

Figure 9:
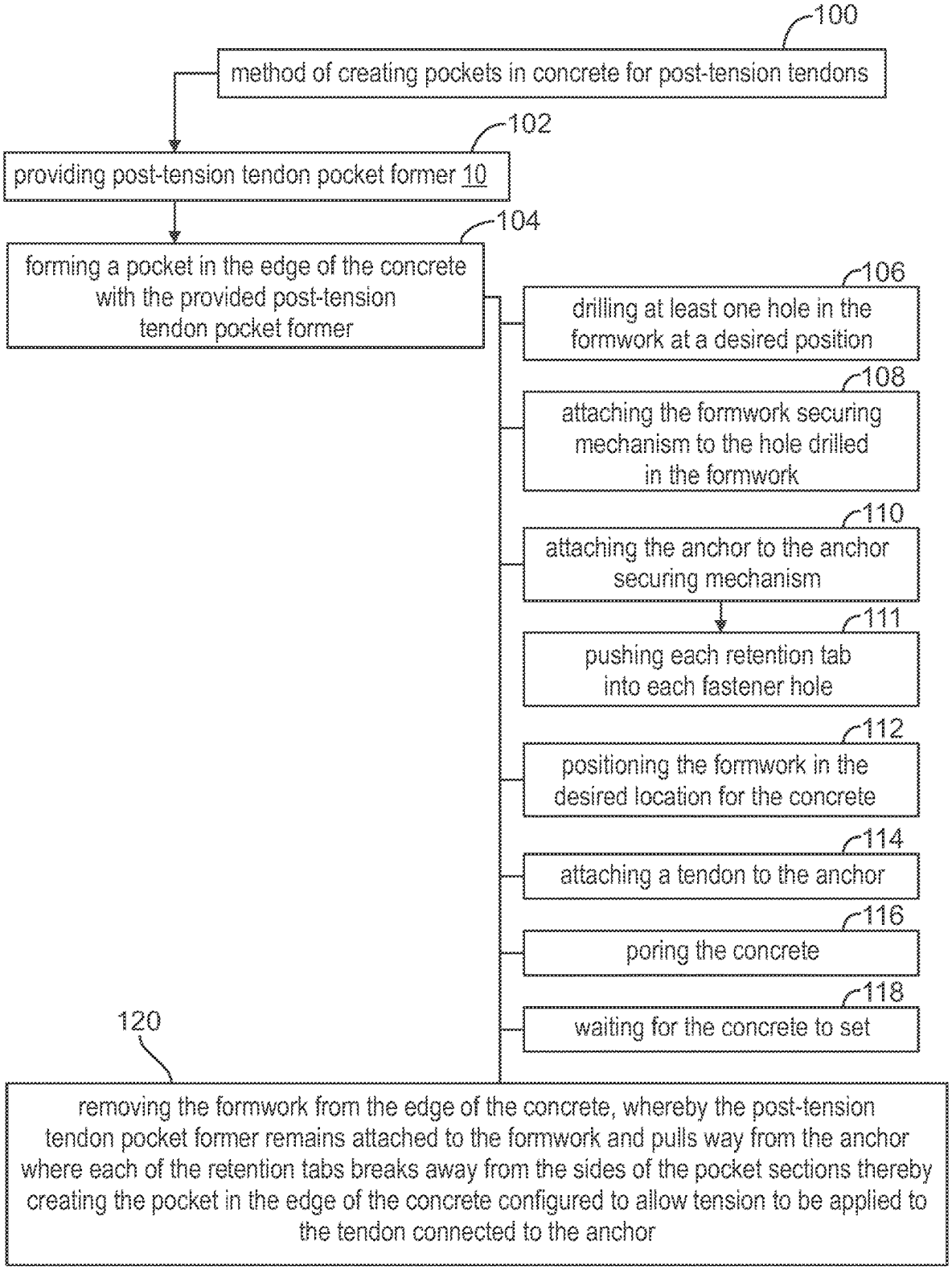
FIG. 9 is a flow diagram according to select embodiments of the instant method of creating pockets in concrete for post-tension tendons.

Referring now to FIG. 9, method 100 of creating pockets in concrete for post-tension tendons is shown. Method 100 of creating pockets in concrete for post-tension tendons generally may include step 102 of providing one-piece post-tension tendon pocket former 10 with push in retention tabs 74 in any of the various embodiments shown and/or described herein. As such, the provided one-piece post-tension tendon pocket former 10 with push in retention tabs 74 may generally include pocket section 12, formwork securing mechanism 34 and anchor securing mechanism 60. Pocket section 12 may be configured to create the pocket in the edge of concrete. Pocket section 12 may include first end 20 and second end 22. Formwork securing mechanism 34 may be connected to second end 22 of pocket section 12. Formwork securing mechanism 34 may be configured to secure second end 22 of pocket section 12 to formwork 36. Anchor securing mechanism 60 may be connected to first end 20 of pocket section 12. Anchor securing mechanism 60 may be configured to secure first end 20 of pocket section 12 to anchor 28. Wherein, using this provided one-piece post-tension pocket former 10, method 100 of creating pockets in concrete for post-tension tendons 26 may also include step 104 of forming pockets in an edge of concrete with the provided one-piece post-tension tendon pocket former 10. Method 100 of creating pockets in concrete for post-tension tendons 26 may include any additional steps or methods whether common, known, or discovered in the future for creating pockets in concrete for post-tension tendons 26. In select embodiments of method 100 of installing post-tension tendons 26 in concrete, step 104 of forming pocket in edge of concrete with the provided one-piece post-tension tendon pocket former 10 may also include: step 106 of drilling at least one hole 42 in formwork 36 at desired position; step 108 of attaching formwork securing mechanism 34 to hole 42 drilled in formwork 36; step 110 of attaching anchor 28 to anchor securing mechanism 60 including step 111 of pushing each retention tab into one of the fastener holes; step 112 of positioning formwork 36 in desired location for concrete; step 114 of attaching tendon 26 to anchor 28; step 116 of pouring concrete; step 118 of waiting for concrete to set; and step 120 of removing formwork 36 from the edge of the concrete (see FIG. 8C). Whereby, one-piece post-tension pocket former 10 may remain attached to formwork 36 and pulls away from the edge of the concrete with anchor 28 positioned therein where each of the retention tabs 74 breaks away from the sides of the pocket section, thereby, creating the pocket in the edge of the concrete. This pocket created in the edge of the concrete may be configured to allow: tension to be applied to tendon 26 connected to anchor 28, tendon 26 to be cut, grease cap/corrosion protection installed, grout applied, the like, etc. However, the order of the steps or processes of method 100 of creating pockets in concrete for post-tension tendons 26 are not so limited to the order shown and/or described herein and various other orders or embodiments can be used (i.e. formwork 36 can be placed before holes 42 are drilled).

In sum, one-piece post-tension tendon pocket former 10 may be included with ribbed formwork securing mechanism 34. One-piece post-tension tendon pocket former 10 thus is a one-piece pocket former 10 that secures and aligns anchor 28 in one step to plywood formwork 56, or the like. The use of one-piece post-tension pocket former 10 may make it easy for a single man installation in a fraction of the time. Formwork ribs 40 may help to prevent backout, that typically may occur with a nailed system. Additionally, if fasteners are going to be used it is still a one-man job as anchor 28 can be held in place with one-piece post-tension pocket former 10 while the fasteners are installed. This clearly provides an improvement and advantage of current pocket formers for post tension cables, which only provide a small alignment ring for the anchor to plywood connection. This requires the user to hold the anchor in alignment and secure it using nails or screws. Holding the anchor, nail and a hammer is difficult in open situations but even harder in tight spaces, such as beams and columns with rebar. Holding the anchor, nail, and hammer using one person is very difficult. When the area has rebar the installation may require the use of a "pea shooter" to install the nails. The typical installation would require two people. Others have used a threaded mandrel and nut that secures the anchor to the plywood formwork, but this still requires two people in areas where the opposing side of the formwork is not easily accessible. The mandrel approach also requires multiple pieces which makes it cumbersome.

As such, unlike the disclosed one-piece post-tension pocket former 10, currently all of the known one-piece pocket formers and anchor assemblies require nails or screws to hold the assembly in place during tendon installation and concrete placement. The installation of nails into the plywood is difficult because of rigidity and having to hold everything at one time. Screws may make this easier but can make removal of the forms difficult. Both screws and nails are difficult to install and require extensions and creative methods when rebar is installed before the tendons are installed.

The disclosure of the instant one-piece post-tension tendon pocket former 10 may utilize angled directional formwork ribs 40 to allow the pocket former to penetrate hole 42 in plywood formwork 56 (or the like) and prevent easy pullout. This eliminates the need for nails, screws, or opposing nuts. It makes alignment easier and holds the assembly in place allowing for use with and without fasteners. In addition, the pocket former is secured to anchor 28 using push in retention tabs 74 to keep the assembly together. The disclosed one-piece pocket former 10 may thus differ from what currently exists, as the only other "fastener-less" solutions on the market use a threaded plastic mandrel and nut. This increases the number of loose pieces that need to be organized on the job. It also requires access to the opposing side of the form work, which is difficult and dangerous and sometimes impossible in many instances with beams and columns.

The inverted formwork ribs 40 and securing ribs 94 may be the basis of the instant disclosure, as they may be used to secure post-tension tendon pocket former 10 to formwork 36 and likewise to anchor assembly 28. The increased length of alignment shaft 38 is provided to penetrate plywood formwork 56 (or the like) and increase the grip. Large tapered section 24 can be designed, sized or adjusted to suit the needs of the job while leaving the main attaching components alone.

In use, a user would take a commercially available tendon anchor 28 and insert the small tapered section into the anchor assembly. They would use pressure to push each retention tab 74 into each fastener hole 70. After determining the desired location for the anchor 28 in formwork 36 and drilling the proper size of hole 42, a twisting and pushing motion will seat the formwork securing mechanism of pocket former 10 with the anchor assembly into plywood formwork 56, or the like. The user would then apply fasteners if determined necessary. Next, rebar could be applied behind anchor 28 to increase load spread under tension, which will also help to hold anchors 28 in place.

As stated above, currently the installation of a pocket former and post tension anchor assembly required the use of nails, or a special anchor and assembly system. This increases cost and installation time and requires manual removal of the fasteners or components. The use of metallic fasteners has the propensity to result in rust bleeding on the exterior of the building. Additionally, the metallic fasteners create a potential safety hazard as they are left protruding from the concrete surface after removal of the edge form. The disclosed one-piece pocket former 10 with push in retention tabs here solves this problem.

The disclosed one-piece pocket former 10 with push in retention tabs 74 uses the existing nail/fastener holes 70 built in to the anchor 28 to secure the pocket former to the anchor assembly. Then the pocket former utilizes ribbed alignment shaft 38 to secure anchor 28 and pocket former assembly 10 to the concrete formwork 36. Ribs 40 attaching one-piece pocket former 10 to formwork 36 are stronger than push in retention tabs 74 securing the wings to the pocket former sides 78. So, pocket former 10 will be removed when the concrete form is removed. This eliminates a manual process step. This also eliminates the potential from rust bleeding because metallic fasteners are no longer required. It eliminates a safety concern by eliminating a protrusion from the concrete edge form.

The disclosed one-piece pocket former 10 with push in retention tabs 74 may differ from what currently exists. The disclosure uses existing nail/fastener holes 70 that are common place in every manufacturers post tensioning anchor assembly. The use of the nail/fastener holes 70 that are existing in every manufacturer's anchor assembly allows for the wide spread use of this one-piece pocket former 10 without having to make a different anchor or pocket former for every manufacturer. Using a one-piece style pocket former that has a positive capture to the anchor and plywood edge former allows for single user installation. It also prevents losing of the pocket former 10 and anchor attachment because of cable movement.

The existing devices require special anchors and hardware for installation. The special requirements prevent the use of alternate components or universal use. Additionally, securing the pocket former to the anchor can work loose if not secured properly.

The disclosed one-piece pocket former with retention tabs 74 may work with all anchors widely available in the post tension market through the use of nail holes 70 present in all anchors 28.

In use, the user will drill a hole 42 in formwork 36, The user anchor sealing portion 72 into the post tension anchor assembly. Then insert each of the ribbed retention tabs 74, into one of the post tension anchor fastener holes 70. After securing the pocket former to the anchor assembly, then insert the pocket former edge form securement ribs 40 into formwork 36. After the concrete is cast and cured around the post tension anchor, pocket former, and assembly, the formwork is ready to be removed. The formwork will be stripped from the concrete. The formwork securement ribs 40 will be stronger than pocket former retention tabs 74. This will allow the pocket former to strip with formwork 36, eliminating the need for a stripping operation.

The concrete edge form is placed to control the wet poured concrete to set the depth and location. Then holes 42 are drilled in formwork 36 to direct the placement of post tension cables which contribute to the reinforcement and strength of the concrete. Ribbed section 40 of the pocket former is inserted into formwork 36. Spokes 32 of the pocket former help to hold the round shape of the pocket former that allows access to the cable after the concrete cures. The pocket former is attached to the anchor assembly by inserting slight tapered section 62 and small tapered section 66 into the anchor to seal the wedge cavity. At the same time retention tabs 74 are inserted into fastener holes 70 which secure the formwork, pocket former, and anchor assembly. Once the concrete is cured, the formwork 36 is removed from the concrete face, where the strength of ribs 40 is greater than the push in retention tabs 74 thereby causing the pocket former to be removed with formwork 36. This may leave behind a round conical shaped pocket to stress, cut, and seal the cable.

One would make the disclosed pocket former 10 with push in retention tabs 74 through a once piece molding process. The process could be through resin casting, injection molding or any other similar process by which plastics of a similar geometry are made.

The pocket former edge form securement ribs 40 are important to securing the pocket former. The breakaway retention tabs 74 and ribbed pocket former anchor securement fasteners are needed to ensure that the assembly stay together under harsh job site conditions. The wedge cavity seal 76 and wedge cavity protector are needed to ensure concrete doesn't contaminate the wedge cavity of the anchor.

The conical shape area and number of ribs can be configured to any required shape to allow for anchor access that is needed. The ribbed pocket former to anchor securement fasteners can be modified to increase or decrease the diameter for the anchor holes. The pocket former edge form securement ribs can be increased in diameter as needed for different cable sizes. The wedge cavity protection surfaces and diameters can be changed to allow functionality with multiple manufacturers.

When utilizing standard pocket formers, the user has to install nails or screws to secure the anchor and pocket former to the edgeform. This can cause deformation of the pocket former, which can make the stressing and cable cutting operations difficult. If the user is utilizing another pocket former that is nail/fastener-less they require assembly of multiple components in a specific sequence. If a multi-component fastener-less pocket former is used then access to both sides of the edge form is required and can be difficult sometimes. The user of the disclosed one-piece pocket former 10 with push in retention tabs 74 may allow the user to secure the pocket former to the anchor prior to installing the anchor to the edgeform or vice-versa which give the user flexibility in difficult or tight spaces.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A one-piece post-tension tendon pocket former comprising:

a pocket section configured to create a pocket in an edge of concrete, said pocket section including a first end, and a second end;

a formwork securing mechanism connected to the second end of the pocket section, said formwork securing mechanism is configured to secure the second end of the pocket section to a formwork;

an anchor securing mechanism connected to the first end of the pocket section, said anchor securing mechanism is configured to secure the first end of the pocket section to a post-tension tendon anchor with at least one fastener hole, the anchor securing mechanism including:

an anchor sealing portion configured to seal the first end of the pocket section to the post-tension tendon anchor; and at least one retention tab extending from a side of the pocket section, each of the at least one retention tabs is configured to be secured in one of the at least one fastener holes of the post-tension tendon anchor for securing a seal between the anchor sealing portion and the post-tension tendon anchor;

wherein the pocket section, the formwork securing mechanism, and the anchor securing mechanism of the post-tension tendon pocket former are integrally formed to create the one-piece post-tension pocket former.

2. The one-piece post-tension tendon pocket former of claim 1, whereby the one-piece post-tension tendon pocket former is configured so secure and align the anchor to the formwork.

3. The one-piece post-tension tendon pocket former of claim 1, where the post-tension tendon anchor has two fastener holes, wherein the anchor securing mechanism includes:

two retention tabs extending from opposite sides of the pocket section, a first retention tab is configured to be secured in a first fastener hole of the post-tension tendon anchor, and a second retention tab is configured to be secured in a second fastener hole of the post-tension tendon anchor.

4. The one-piece post-tension tendon pocket former of claim 1, wherein each of the at least one retention tabs including:

a transverse member extending away from the side of the pocket section; and a parallel member connected to a distal end of the transverse member, the parallel member extending from the transverse member beyond the anchor sealing portion.

5. The one-piece post-tension tendon pocket former of claim 4, wherein:

the transverse member of each of the at least one retention tabs including a rectangular cross-section; and the parallel member of each of the at least one retention tabs including a circular cross-section.

6. The one-piece post-tension tendon pocket former of claim 4, wherein the parallel member of each of the at least one retention tabs including a securing portion at a securing end of the parallel member, the securing portion is configured to secure the parallel member inside of one of the at least one fastener holes of the post-tension tendon anchor.

7. The one-piece post-tension tendon pocket former of claim 6, wherein the securing portion at the securing end of the parallel member including a plurality of securing ribs.

8. The one-piece post-tension tendon pocket former of claim 7, wherein the plurality of securing ribs on the securing portion at the securing end of the parallel member are angled towards the transverse member, whereby the securing ribs are configured to prevent removal or backing out of the securing portion of the parallel member from the fastener hole of the post-tension tendon anchor; and whereby, the securing ribs slightly deflect during insertion of the securing portion into the fastener hole of the post-tension tendon anchor.

9. The one-piece post-tension tendon pocket former of claim 1, wherein each of the at least one retention tabs is configured to break away from the side of the pocket section when the anchor sealing portion is removed from the post-tension tendon anchor.

10. The one-piece post-tension tendon pocket former of claim 9, wherein each of the at least one retention tabs is configured to break away from the side of the pocket section when the pocket section and the anchor sealing portion is removed from the post-tension tendon anchor via a transverse member of each retention tabs breaking away from the side of the pocket section.

11. The one-piece post-tension tendon pocket former of claim 10, wherein the formwork securing mechanism has more strength than a breaking strength of the transverse member.

12. The one-piece post-tension tendon pocket former of claim 1, wherein the anchor securing mechanism includes:

a slight tapered section connected to the first end of the pocket section configured to seal to an internal anchor assembly seal area of the anchor; and a small tapered section connected to the slight tapered section configured to be inserted into and secured within a tapered receiver of the anchor.

13. The one-piece post-tension tendon pocket former of claim 1, wherein the formwork securing mechanism includes:

an alignment shaft with formwork ribs configured to be inserted into a hole in the formwork; and wherein the alignment shaft has an extended length that extends from the second end of the pocket section to a distal alignment end of the alignment shaft, where the extended length is sized to extend at least a thickness of the formwork, whereby when the alignment shaft of the formwork securing mechanism is inserted through the hole in the formwork where the second end of the pocket section is aligned with an inner surface of the formwork, the distal alignment end of the alignment shaft and at least one of the formwork ribs on the alignment shaft extend beyond an outer surface of the formwork.

14. The one-piece post-tension tendon pocket former of claim 13, wherein the formwork ribs on the alignment shaft of the formwork securing mechanism are angled towards the second end of the pocket section, whereby the formwork ribs are configured to prevent removal or backing out of the alignment shaft once inserted into the hole in the formwork;

wherein the formwork ribs on the alignment shaft of the formwork securing mechanism are tapered, whereby, the formwork ribs are configured to slightly deflect during insertion of the alignment shaft into the hole in the formwork; and whereby, the one-piece post-tension pocket former is configured to create the pocket in the edge of the concrete when the formwork is removed from the edge of the concrete, where the formwork ribs of the one-piece post-tension pocket former are configured to secure the one-piece post-tension pocket former away from the edge of the concrete with the formwork for creating the pocket in the edge of the concrete.

15. The one-piece post-tension tendon pocket former of claim 1, wherein the formwork securing mechanism is configured to secure the second end of the pocket section to a plywood formwork or a medium-density fiberboard formwork.

16. The one-piece post-tension tendon pocket former of claim 1, wherein the pocket section has a large tapered section between the first end and the second end configured to create the pocket in the edge of the concrete configured to allow tension to be applied to a tendon connected to the anchor;

wherein the large tapered section of the pocket section includes a hollow interior supported by a plurality of spokes; and wherein the hollow interior of the large tapered section of the pocket section includes five spokes for supporting the hollow interior.

17. A one-piece post-tension tendon pocket former comprising:

a pocket section configured to create a pocket in an edge of concrete, said pocket section including a first end, and a second end, the pocket section has a large tapered section between said first end and said second end configured to create the pocket in the edge of the concrete, where the pocket is configured to allow tension to be applied to a tendon connected to a post-tension tendon anchor, wherein the large tapered section of the pocket section includes a hollow interior supported by a plurality of spokes;

a formwork securing mechanism connected to the second end of the pocket section, said formwork securing mechanism is configured to secure the second end of the pocket section to a formwork, wherein the formwork securing mechanism includes:

an alignment shaft with formwork ribs configured to be inserted into a hole in the formwork, the formwork ribs on the alignment shaft of the formwork securing mechanism are angled towards the second end of the pocket section, whereby the formwork ribs are configured to prevent removal or backing out of the alignment shaft once inserted into the hole in the formwork;

the formwork ribs on the alignment shaft of the plywood are tapered, whereby, the formwork ribs slightly deflect during insertion of the alignment shaft into the hole in the formwork, whereby, the post-tension pocket former is configured to create the pocket in the edge of the concrete when the formwork is removed from the edge of the concrete, where the formwork ribs of the post-tension pocket former are configured to secure the post-tension tendon pocket former to the hole in the formwork, thereby, removing the post-tension tendon pocket former away from the edge of the concrete with the formwork for creating the pocket in the edge of the concrete;

the alignment shaft has an extended length that extends from the second end of the pocket section to a distal alignment end of the alignment shaft, where the extended length is sized to extend at least a thickness of the formwork, whereby when the alignment shaft of the formwork securing mechanism is inserted through the hole in the formwork where the second end of the pocket section is aligned with an inner surface of the formwork, the distal alignment end of the alignment shaft and at least one of the formwork ribs on the alignment shaft extend beyond an outer surface of the formwork;

wherein the formwork securing mechanism is configured to secure the second end of the pocket section to a plywood formwork or a medium-density fiberboard formwork;

an anchor securing mechanism connected to the first end of the pocket section, said anchor securing mechanism is configured to secure the first end of the pocket section to a post-tension tendon anchor with two fastener holes, the anchor securing mechanism including:

an anchor sealing portion configured to seal the first end of the pocket section to the post-tension tendon anchor;

two retention tabs extending from opposite sides of the pocket section, each of the two retention tabs is configured to be secured in one of the two fastener holes of the post-tension tendon anchor for securing the seal between the anchor sealing portion and the post-tension tendon anchor, wherein the anchor securing mechanism includes:

a first retention tab is configured to be secured in a first fastener hole of the post-tension tendon anchor;

a second retention tab is configured to be secured in a second fastener hole of the post-tension tendon anchor;

wherein each of the two retention tabs including:

a transverse member extending away from the side of the pocket section, the transverse member of each of the retention tabs including a rectangular cross-section;

a parallel member connected to a distal end of the transverse member, the parallel member extending from the transverse member beyond the anchor sealing portion, the parallel member of each of the retention tabs including a circular cross-section, the parallel member of each of the two retention tabs including a securing portion at a securing end of each parallel member, the securing portion is configured to secure the parallel member inside of one of the two fastener holes of the post-tension tendon anchor, wherein the securing portion at the securing end of each parallel member including a plurality of securing ribs, the plurality of securing ribs are angled towards the transverse member, whereby the securing ribs are configured to prevent removal or backing out of the securing portion of the parallel member from one of the two fastener holes of the post-tension tendon anchor, and whereby, the securing ribs slightly deflect during insertion of the securing portion into one of the two fastener holes of the post-tension tendon anchor;

wherein each of the two retention tabs is configured to break away from the side of the pocket section when the pocket section with the anchor sealing portion is removed from the post-tension tendon anchor via the transverse member of each retention tab breaking away from the side of the pocket section, where the formwork securing mechanism has more strength than a breaking strength of the transverse member;

wherein the anchor securing mechanism includes:

a slight tapered section connected to the first end of the pocket section configured to seal to an internal anchor assembly seal area of the anchor;

a small tapered section connected to the slight tapered section configured to be inserted into and secured within a tapered receiver of the anchor;

wherein the pocket section, the formwork securing mechanism, and the anchor securing mechanism of the post-tension tendon pocket former are integrally formed to create a one-piece pocket former; and whereby the post-tension tendon pocket former is configured so secure and align the to the formwork.

18. A method of creating a pocket in concrete for post-tension tendons comprising:

providing a one-piece post-tension tendon pocket former comprising:

a pocket section configured to create the pocket in an edge of concrete, said pocket section including a first end, and a second end;

a formwork securing mechanism connected to the second end of the pocket section, said formwork securing mechanism is configured to secure the second end of the pocket section to a formwork;

an anchor securing mechanism connected to the first end of the pocket section, said anchor securing mechanism is configured to secure the first end of the pocket section to a post-tension tendon anchor with at least one fastener hole, the anchor securing mechanism including:

an anchor sealing portion configured to seal the first end of the pocket section to the post-tension tendon anchor;

at least one retention tab extending from a side of the pocket section, each of the at least one retention tabs is configured to be secured in one of the at least one fastener holes of the post-tension tendon anchor for securing the seal between the anchor sealing portion and the post-tension tendon anchor;

forming the pocket in the edge of the concrete with the provided one-piece post-tension tendon pocket former;

wherein forming a pocket in the edge of the concrete with the provided post-tension tendon pocket former includes:

drilling at least one hole in the formwork at a desired position;

attaching the formwork securing mechanism to the hole drilled in the formwork;

attaching the anchor to the anchor securing mechanism including pushing each of the at least one retention tabs into one of the at least one fastener holes;

positioning the formwork in a desired location for the concrete;

attaching a tendon to the anchor;

pouring the concrete;

waiting for the concrete to set; and removing the formwork from the edge of the concrete, whereby the post-tension pocket former remains attached to the formwork and pulls away from the anchor where each of the retention tabs breaks away from sides of the pocket section, thereby creating the pocket in the edge of the concrete configured to allow tension to be applied to the tendon connected to the anchor, a cable to be cut, grease cap/corrosion protection installed, grout applied, or combinations thereof.

* * * * *